US011358019B2

(12) United States Patent
Tang

(10) Patent No.: US 11,358,019 B2
(45) Date of Patent: Jun. 14, 2022

(54) FITNESS DEVICE AND EXERCISE METHOD FOR GENERATING OPPOSING MUSCLE RESISTANCE

(71) Applicant: Michael Wayne Tang, Taipei (TW)

(72) Inventor: Michael Wayne Tang, Taipei (TW)

( * ) Notice: Subject to any disclaimer, the term of this patent is extended or adjusted under 35 U.S.C. 154(b) by 0 days.

(21) Appl. No.: 16/108,880

(22) Filed: Aug. 22, 2018

(65) Prior Publication Data

US 2019/0054338 A1 Feb. 21, 2019

Related U.S. Application Data

(63) Continuation of application No. 15/029,280, filed as application No. PCT/US2014/061101 on Oct. 17, 2014, now abandoned.

(Continued)

(51) Int. Cl.
*A63B 21/068* (2006.01)
*A63B 21/04* (2006.01)

(Continued)

(52) U.S. Cl.
CPC ..... *A63B 21/068* (2013.01); *A63B 21/0023* (2013.01); *A63B 21/0414* (2013.01); *A63B 21/0552* (2013.01); *A63B 21/4023* (2015.10); *A63B 21/4033* (2015.10); *A63B 21/4034* (2015.10); *A63B 21/4035* (2015.10); *A63B 23/03516* (2013.01); *A63B 23/03533* (2013.01); *A63B 23/03575* (2013.01); *A63B 23/1209* (2013.01); *A63B 23/1218* (2013.01); *A63B 23/1227* (2013.01); *A63B 23/1281* (2013.01); *A63B 21/00069* (2013.01); *A63B 21/0442* (2013.01); *A63B 21/0557* (2013.01);

(Continued)

(58) Field of Classification Search
CPC ..... A63B 21/002–0023; A63B 21/068; A63B 21/4023; A63B 2023/006; A63B 21/0442; A63B 21/4033; A63B 21/4034; A63B 21/4035; A63B 23/0211; A63B 23/0222; A63B 23/03516; A63B 23/03525; A63B 23/03541; A63B 23/03533; A63B 23/0355; A63B 23/03575; A63B 23/0494; A63B 23/0411; A63B 23/1209; A63B 23/1218; A63B 23/1227; A63B 23/1281
See application file for complete search history.

(56) References Cited

U.S. PATENT DOCUMENTS 3,119,614 A * 1/1964 Berry ..... A63B 21/0023 482/91
5,518,486 A * 5/1996 Sheeler ..... A63B 21/0004 482/131

(Continued)

FOREIGN PATENT DOCUMENTS

CN 101325987 A 12/2008
CN 101766884 A 7/2010
WO WO-2007/079281 A2 7/2007

*Primary Examiner* — Jennifer Robertson
(74) *Attorney, Agent, or Firm* — Harness, Dickey & Pierce, P.L.C.

(57) ABSTRACT

A fitness device contains a strap, a handle, and a plate. The strap is substantially inelastic and flexible. The plate is substantially rigid. The handle at least partially envelopes the strap. A method of exercising with such a fitness device is also described herein. Other fitness devices and other methods of use are also described herein.

16 Claims, 7 Drawing Sheets

Related U.S. Application Data

(60) Provisional application No. 61/891,986, filed on Oct. 17, 2013, provisional application No. 61/910,612, filed on Dec. 2, 2013, provisional application No. 61/910,602, filed on Dec. 2, 2013, provisional application No. 61/910,626, filed on Dec. 2, 2013.

(51) Int. Cl.

| | |
|---|---|
| ***A63B 23/12*** | (2006.01) |
| ***A63B 21/00*** | (2006.01) |
| ***A63B 21/002*** | (2006.01) |
| ***A63B 21/055*** | (2006.01) |
| ***A63B 23/035*** | (2006.01) |
| ***A63B 21/16*** | (2006.01) |
| ***A63B 21/28*** | (2006.01) |
| ***A63B 23/02*** | (2006.01) |
| ***A63B 23/04*** | (2006.01) |
| ***A63B 71/00*** | (2006.01) |
| ***A63B 71/02*** | (2006.01) |

(52) U.S. Cl.

CPC ..... *A63B 21/169* (2015.10); *A63B 21/1618* (2013.01); *A63B 21/28* (2013.01); *A63B 23/0211* (2013.01); *A63B 23/0222* (2013.01); *A63B 23/0355* (2013.01); *A63B 23/03525* (2013.01); *A63B 23/03541* (2013.01); *A63B 23/0494* (2013.01); *A63B 2023/0411* (2013.01); *A63B 2071/0018* (2013.01); *A63B 2071/026* (2013.01); *A63B 2209/02* (2013.01); *A63B 2209/08* (2013.01); *A63B 2209/10* (2013.01); *A63B 2210/00* (2013.01); *A63B 2210/50* (2013.01); *A63B 2220/52* (2013.01); *A63B 2225/02* (2013.01); *A63B 2225/09* (2013.01); *A63B 2225/50* (2013.01)

(56) References Cited

U.S. PATENT DOCUMENTS

| | | | | |
|---|---|---|---|---|
| 7,785,243 | B2 * | 8/2010 | Kassel | A63B 21/00185 482/121 |
| 9,114,270 | B2 * | 8/2015 | Aldridge | A61H 1/0237 |
| 2005/0130812 | A1 * | 6/2005 | DiOrio | A63B 21/0023 482/91 |
| 2008/0214370 | A1 | 9/2008 | Terry et al. | |
| 2010/0167884 | A1 | 7/2010 | Kassel | |

* cited by examiner

FITNESS DEVICE AND EXERCISE METHOD FOR GENERATING OPPOSING MUSCLE RESISTANCE

CROSS-REFERENCE TO RELATED APPLICATIONS

This application is a continuation of U.S. patent application Ser. No. 15/029,280 filed on Apr. 14, 2016 which is a 371 of PCT International Application No. PCT/US2014/061101 filed on Oct. 17, 2014, and which application claims the benefit of U.S. Provisional Application No. 61/891,986 filed on Oct. 17, 2013, and of U.S. Provisional Application No. 61/910,612 filed on Dec. 2, 2013, and of U.S. Provisional Application No. 61/910,602 filed on Dec. 2, 2013, and of U.S. Provisional Application No. 61/910,626 filed on Dec. 2, 2013. The entirety of each of the above applications is incorporated herein by reference.

FIELD OF THE INVENTION

The invention relates to a fitness device and an exercise method. More specifically, the invention relates to a fitness device which is easily transportable and an exercise method which may be used in a small amount of space.

BACKGROUND

It is difficult and/or impossible to generate certain types of muscle resistance for the purpose of exercise without fitness (a.k.a. exercise) equipment. Most fitness equipment such as free weights, Nautilus machines, universal machines, etc. is heavy, large and requires a great deal of space and/or a specific architectural or room configuration. Typical exercise equipment can also be difficult to maintain, store and use safely and is usually not portable. Also, gym and fitness equipment often becomes dirty, sweaty and unsanitary as it is typically very difficult to clean and sanitize.

Existing fitness equipment inherently suffers from various drawbacks as well. Bodyweight and suspension exercises are limited to certain maximum resistance weights (typically a small percentage of bodyweight), room configurations (suspension requires a frame or that anchor points to be available in specific areas), certain muscle groups (body geometry limits the ability to work certain muscle groups) and may require physically uncomfortable positions (such as hanging upside down). Resistance bands require a large number of bands (one for each resistance), require maintenance to avoid injury or breakage and provide inconsistent levels of linear resistance. Free weights (including free weight machines) are expensive, heavy and difficult to store, change, and/or move. Free weights also require large amounts of space and more importantly require spotting to safely use without injury. Free weights are not portable or easy to travel with.

Most people do not exercise because it is inconvenient, difficult and/or expensive. Either one would need to incur the cost, travel time and inconvenience of traveling to a gym, or the additional cost, space and inconvenience of creating a gym at home. Home alternatives (such as bodyweight and suspension) require a great deal of knowledge, training, large & specific space requirements, and in the case of suspension, expensive equipment and a room with geometry beneficial to the securing to the required anchoring points.

Furthermore, many people do not desire to go to a local gym or fitness center and to exercise in front of other people, especially if they are embarrassed of their weight, ability, shape, and/or are otherwise self-conscious. Other people may not want to go to a gym due to other privacy concerns. Many people would therefore prefer to exercise in the comfort of their own home, or hotel room if they are traveling. Travelers are especially inconvenienced as they are often unable to continue exercising in their preferred method and with their preferred equipment because many locations will not have the same types or styles of equipment as what they are used to using when they are home. Most types of exercise equipment cannot be easily brought along on a trip, in the car, or on the airplane. This requires the user to adapt their exercise regimen to whatever equipment and/or systems are available at the locale. Travelers do not wish to have to bring bulky equipment with them, or in the case of, for example, resistance bands, they may not wish to bring many heavy bands to achieve the desired resistance for effective exercise.

In cases where mankind has traveled in space for extended periods of time a major concern is physical wastage and deterioration of muscle mass due to the lack of exercise. Exercise in space is complicated by to the lack of, or reduction of, gravity. Most fitness systems require gravity for effective use, and the existing use of resistance bands does not adequately compensate for the lack of gravity-based exercise equipment in space. As mankind seeks to remain in space for longer periods of time, such a lack of adequate fitness equipment is a major concern.

As such, there is a need in the industry for an improved fitness device and method that is portable, easy to use, easy to clean and/or sanitize, etc. There also exists a need for a fitness device and exercise method which can create opposing muscle resistance while providing consistent tension. The need also exists for a fitness device which can be used by a person alone without a significant chance of injury. The need exists for a fitness device which is easily portable and movable, and may be easily brought when the user travels. The need also exists for a fitness device and exercise method which can be effectively used without the need for gravity. The need also exists for a fitness device and exercise method which allows exercise of multiple muscle groups without the need for excess amounts of equipment. There also exists the need for a fitness device and exercise method which allows a user to exercise in the comfort of their own home, room and/or hotel room, away from the eyes of strangers and so as to avoid embarrassment to those who are self-conscious and/or those who desire privacy when exercising. There also exists a need for fitness device and exercise methods which are more convenient and targeted for those undergoing physical therapy. There also exists a need for a fitness device which may be easily taken on an airplane.

SUMMARY OF THE INVENTION

A method allows a person to create consistent muscle resistance without the use of a spotter or heavy exercise equipment by providing a strap containing at least one loop proximal a first end and a second end distal to the first end, removably securing the second end of the strap to a fixed object, and creating muscle resistance by pulling the first end away from the second end by using the loop.

A fitness device is configured so that the user can create internal muscle resistance without the use of a spotter or heavy exercise equipment while supplying the user a consistent resistance by orienting the body in a certain position while directing the location of a strap and handles with the user's body, the portable fitness device containing a strap, whereby the strap contains a webbed strapping, and a plurality of handles wherein the plurality of handles have a plurality of inner rails containing webbed strapping.

A fitness device contains a strap, a handle, and a plate. The strap is substantially inelastic and flexible. The plate is substantially rigid. The handle at least partially envelopes the strap. A method of exercising with such a fitness device is also described herein.

Without intending to be limited by theory, it is believed that the present fitness device and exercise method may provide one or more of the benefits described herein. It is an intention that the fitness device is easy to use, easy to clean, and/or easy to sanitize. The fitness device and exercise method may be able to create opposing resistance while providing constant tension. The fitness device and method herein may be used by a person alone without a significant chance of injury. The fitness device may be easily portable and movable, and may be easily brought when the user travels. Surprisingly, the fitness device and exercise method which can be effectively used without the need for gravity. The fitness device and exercise method may allow exercise of multiple muscle groups without the need for excess amounts of equipment. Due to its portability, the fitness device and exercise method may allow a user to exercise in the comfort of their own home, room and/or hotel room, away from the eyes of strangers and so as to avoid embarrassment to those who are self-conscious and/or those who desire privacy when exercising. The fitness device and exercise methods may be more convenient and targeted for those undergoing physical therapy. Also, the fitness device herein may be easily taken on an airplane as some embodiments may lack any metal or dangerous parts.

and

Figure 10:
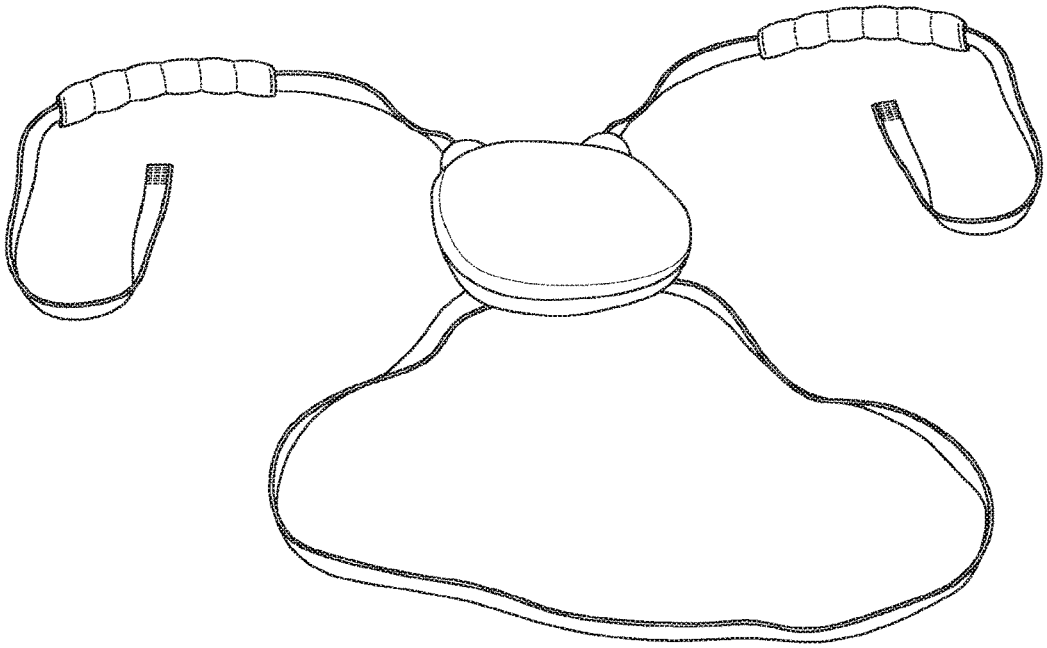

FIG. 10 shows an embodiment of the fitness device further containing a cushioned fulcrum.

Figure 11:
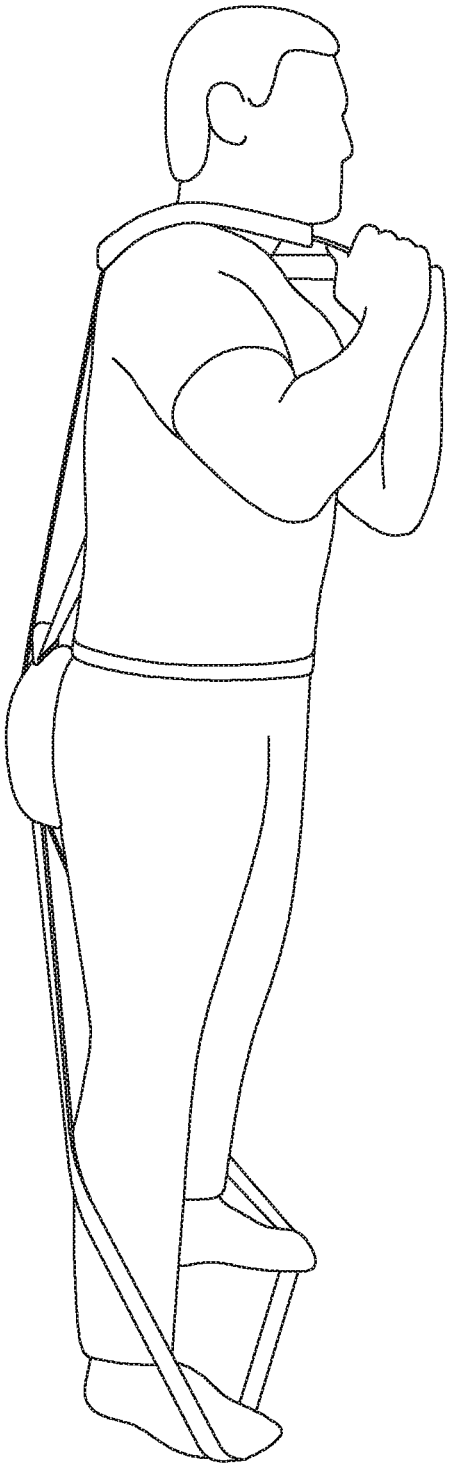

FIG. 11 is a perspective view of the embodiment of the portable fitness device of FIG. 10 in use with the cushioned fulcrum positioned over the user's buttocks on the posterior end of the body, while the user holds the outer locking grips.

The figures herein are for illustrative purposes only and are not necessarily drawn to scale.

DESCRIPTION OF THE PREFERRED EMBODIMENTS

Unless otherwise specifically provided, all tests herein are conducted at standard conditions (if applicable) which include a room and testing temperature of 25° C., sea level (1 atm.) pressure, and pH 7 and all measurements are made in metric units. Furthermore, all percentages, ratios, etc. herein are by weight, unless specifically indicated otherwise.

Certain terminology has been replaced with respect to the language used in the priority documents. We believe that one skilled in the art will recognise this and understand that the present terminology is more consistent and easy to understand as compared to the various terms used in the priority documents. With respect to the terminology used herein, the term "handle" as used herein is equivalent to the term "outer grips" as used in the priority documents. Thus, a "handle with a locking mechanism" as used herein is equivalent to the "outer locking grip" described in the priority document.

With respect to the term "inner support struts" used in the priority documents, one skilled in the art would understand that this corresponds to the "rails" as used herein.

With respect to the term "length of non-elastic fabric" used in one or more of the priority documents, one skilled in the art would understand that this corresponds to the "strap" as used herein. With respect to the term "anchor" and its various forms as used in one or more of the priority documents, one skilled in the art would understand this to correspond to the term "secure" and its various forms as used herein.

With respect to the term "envelop", this means that the an item is at least partially wrapped around another item. Thus, if the handle "at least partially envelops the strap," then this means that this term encompasses both when the handle is wrapped around at least a portion of the strap's length but other parts of the strap are not enveloped by the handle, and when the handle may be, for example, a U-shaped piece which envelops the strap on 3 sides but is open at the top.

An embodiment of the present invention relates to a method of allowing a person to create consistent muscle resistance without the use of a spotter or without heavy exercise equipment by providing a strap having at least one loop proximal to a first end and a second end distal to the first end, removably securing the second end of the strap to a fixed object, and creating muscle resistance by pulling the first end away from the second end by using the loop.

An embodiment of the present invention relates to a fitness device configured so that the user can create internal muscle resistance without the use of a spotter or heavy exercise equipment while supplying the user with a consistent resistance by orienting the body in a certain position while directing the location of strap and handles with the user's body. The fitness device contains a strap and a plurality of handles. The strap contains a webbed strapping while the plurality of handles have a plurality of inner rails containing webbed strapping.

An embodiment herein relates to a fitness device having a strap, a handle and a plate where the handle at least partially envelops the strap. The strap is substantially inelastic and is also flexible, while the plate is substantially rigid.

An embodiment of the invention relates to a method of exercising by providing a fitness device as described herein, securing at least a portion of the fitness device to a body portion, securing a separate portion of the fitness device to a location, and exercising by moving the body portion such that muscle resistance is created. The location is selected from the group of a body part, a door, a fixed object, and a combination thereof. Accordingly, the fitness device may contain a loop, clip, or other adapter which is designed to secure the fitness device to, for example, a hook secured in a wall, etc.

The fitness device herein is easily portable, light, and highly flexible which allows a user to exercise virtually any muscle or muscle group. The optional ability of the handles to slide along the strap and yet easily lock into place further provide flexibility for when either a long strap is desired, or a short strap is desired. Furthermore the exercises possible with such a fitness device may be easily customised for individual training regimens.

Without intending to be limited by theory it is believed that the present fitness equipment and exercise method effectively may pit smaller muscle (or muscle groups) against larger muscles (or muscle groups) thereby generating sufficient muscle resistance so as to allow effective exercise. As such resistance is internally-generated by the user and the fitness device, such a device may be effectively used regardless of the orientation with respect to gravity. Therefore, users who are unable to stand erect, or even those without gravity at all (e.g. Astronauts or those in limited gravity situations) may benefit from this invention.

In an embodiment herein, the user would anchoring one or more of the extremities attached to the weaker and/or smaller muscle/muscle-group that the user intends to work; the user then configures the length strap in the form specified and anchors one or more additional extremities anchored to the stronger and/or larger muscle/muscle-group that the user intends to work. The user will use the weaker and/or smaller muscle/muscle-group at its maximum potential while using the stronger and/or larger muscle/muscle-group to move the smaller and/or weaker muscle/muscle group through its normal and complete range of motion for that muscle/muscle-group's associated joint(s). The method of use works by redirecting and repositioning the kinetic force and angle of the resistance generated by large muscle groups to create internal muscle resistance supplied to the smaller muscle groups without the use of gravity resisted weight or external resistance. Thus, internal muscle resistance as used herein indicates that such resistance is generated within the system including the fitness device and the user, rather than due to external forces such as gravity.

In an embodiment herein, the user secures one or more body portions, including hands and/or feet, to a portion of the fitness device, especially a strap. This can be done in multiple ways including but not limited to wrapping techniques, a handle, a shaped handle, a grip, and/or a removable and/or permanent accessory such as a loop, a clasp and/or a clip. Below are various examples of methods for anchoring the hands to the strap using only the strap and wrapping methods.

In situations where the users hand(s) are secured to the strap in such a way in which the middle of the strap exits the secured hand on the inferior side and the end(s) of the strap exit the side of the users thumb (assuming the strap is laid across the palm of the users hand evenly in a neutral position with the hand neither supinated nor pronated); The user would begin by pinching the strap between the first and second metacarpals leaving the end of the strap pointed superior. The user would then grab the end of the strap that is exiting inferior the anchored hand and wrap the length of strap to the posterior to the hand along the back of the hand (looping around the fifth metacarpal), then back up along the posterior of the hand and looping up and around the 2nd metacarpal returning the middle side of the strap to the anterior of the hand again exiting the palm of the secured hand on the non-thumb side of the hand.

In situations where the users hand(s) are secured to the strap in such a way in which the end(s) of the strap exits the secured hand on the inferior side and the middle of the strap exit the side of the users thumb (assuming the strap is laid across the palm of the users hand evenly in a neutral position with the hand neither supinated nor pronated); The user would begin by pinching the strap between the first and second metacarpals leaving the end of the strap pointed inferior. The user would then grab the end of the strap that is exiting inferior the anchored hand and wrap the length of strap to the posterior to the hand along the back of the hand (looping around the fifth metacarpal), then back up along the posterior of the hand and looping up and around the 2nd metacarpal returning the end of the strap to the anterior of the hand again. The user then runs the end of the strap back down exiting the palm of the secured hand on the non-thumb side of the hand.

Upon a full reading of this specification, other securing methods would be easily envisaged as well.

Figure 1:
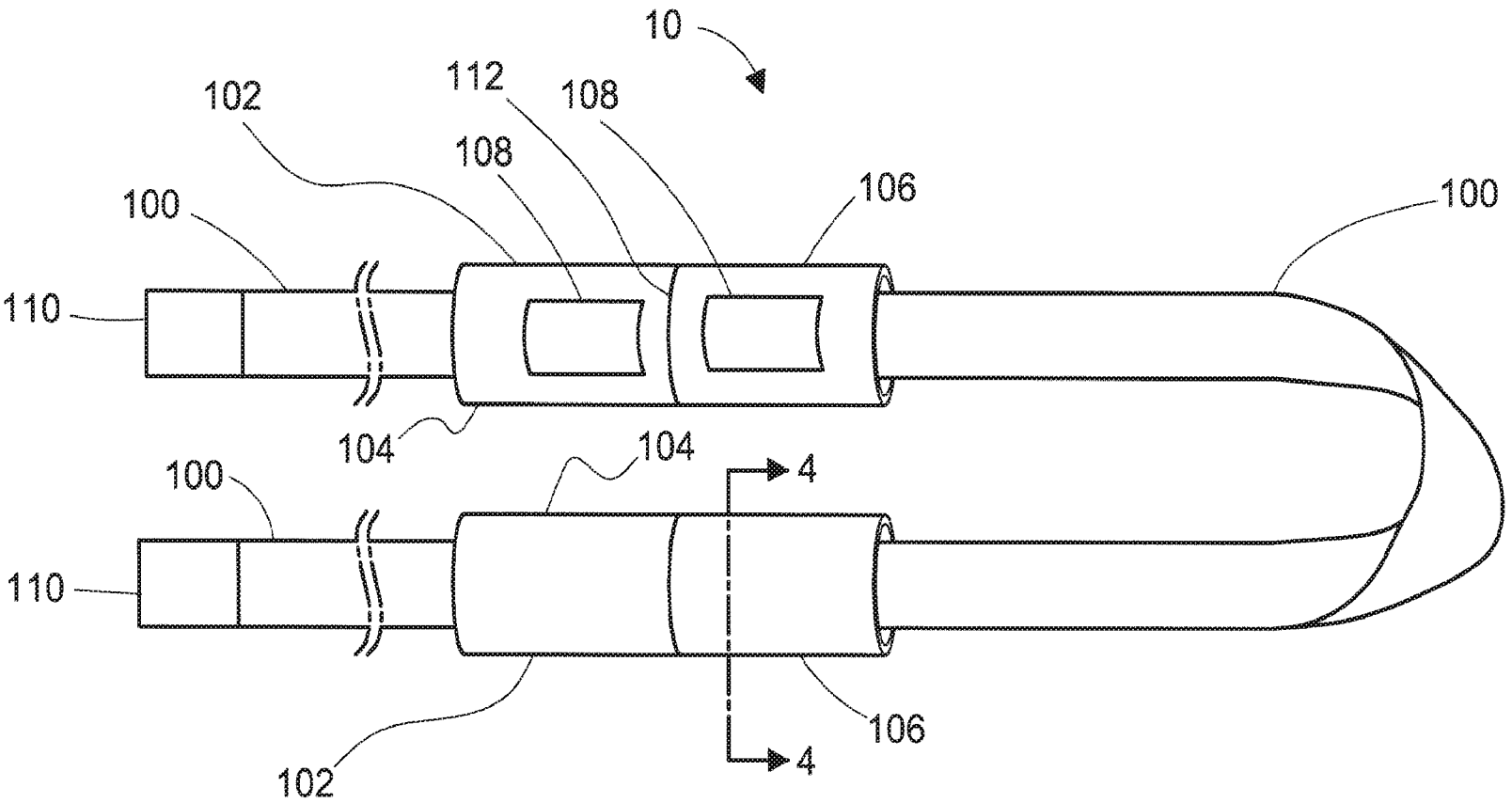
FIG. 1 shows a plan view of an embodiment of the fitness device herein.

Turning to the figures, FIG. 1 shows a plan view of an embodiment of the fitness device, 10. A strap, 100, is at least partially enveloped by a handle, 102. The handle contains a first grip portion 104, and a second grip portion, 106. The first grip portion, 104, and the second grip portion, 106, contain a locking mechanism, 108, thereupon which interacts to lock the first grip portion, 104, to the second grip portion, 106. In the embodiment of FIG. 1, when the handle, 102, is folded in half along the folding line, 112, then the locking mechanisms, 108 of the first grip portion, 104 and the second grip portion, 106, reversibly lock together.

In FIG. 1, the strap, 100, terminates at both ends in a strap end, 110. The strap end, 110, is typically designed such that the handle, 102, may not easily slide over the strap end, 110, when the fitness device, 10, is in use. In such a case, the strap end, 110, may physically block the handle, 102, from sliding off of the strap, 100. In an embodiment useful herein, the strap end, 110, is formed of the strap, 100, which has been folded over itself at least once; or twice; or multiple times, and then been sewn or otherwise fused together. In an embodiment the strap end is from about 0.3 cm to about 1.5 cm; or from about 0.4 to about 1.2 cm thick. In an embodiment herein the strap end is from about 0.2 cm to about 10 cm; or from about 0.3 to about 8 cm; or from about 0.5 to about 7 cm in length. The strap end will typically be about the same width as the strap, or from about 100% to about 150% of the width of the strap. In an embodiment herein, the strap end is formed of a separate material such as a rubber or plastic end piece.

In an embodiment herein, the handles may further contain a flexible cover which may be permanently-affixed or may be removable. In an embodiment herein, the handle contains neoprene, and/or polyurethane as the flexible cover.

Due to the usage and required durability of the fitness device, many particular pieces such as the strap ends, the handles, etc. will need to be permanently affixed together. In such cases, it is preferred that sewing; or stitching; or bar tacking, is used as such a method is durable, and survives multiple washing cycles. In such sewing, it is preferred that nylon or kevlar thread is employed.

The strap is substantially inelastic, which means that when pulled lengthwise, the strap stretches less than 4% (i.e., 4 cm for each 100 cm of strap)., or less than 3%, or less than 2%. Such an inelastic property may be due to the strap material itself, or due to the weave and/or pattern, if present. Suitable strap materials include, for example nylon straps, silk straps, kevlar straps, and a combination thereof. Other materials may also useful herein especially if they have a similar friction coefficient as nylon. Straps useful herein are known in the art and are typically used as straps for backpacks, briefcases, camping equipment, etc.

The strap is typically from about 1.5 meters to about 8 meters; or from about 2 meters to about 7.5 meters; or from about 2.5 meters to about 6.5 meters in length. The strap is typically from about 1 cm to about 8 cm; or about 1.5 to about 6 cm; or from about 2 to about 4 cm in width. The strap is typically from about 0.5 mm to about 10 mm; or about 1 mm to about 7 mm in thickness.

In an embodiment herein, the fitness device contains from about 2 handles to about 6 handles; or from about 2 to about 4 handles. Each individual handle may be designed to at least partially envelop the strap, and may be permanently affixed to the strap or may be removable. Furthermore, when enveloping the strap, each individual handle may be designed to be slideably adjustable along the length of the strap, or may be affixed to a single position thereupon. In an embodiment of the invention, the handle is a removable handle which may be either affixed to a single position on the strap, or may be slideably adjustable along the length strap, depending upon how tightly it is affixed onto the strap.

The handle herein is typically from about 4 cm to about 40 cm; or from about 6 cm to about 35 cm; or from about 10 cm to about 32 cm long. The handle herein is typically from about 1 cm to about 15 cm; or from about 2 cm to about 10 cm; or from about 2.5 cm to about 8 cm wide.

Figure 2:
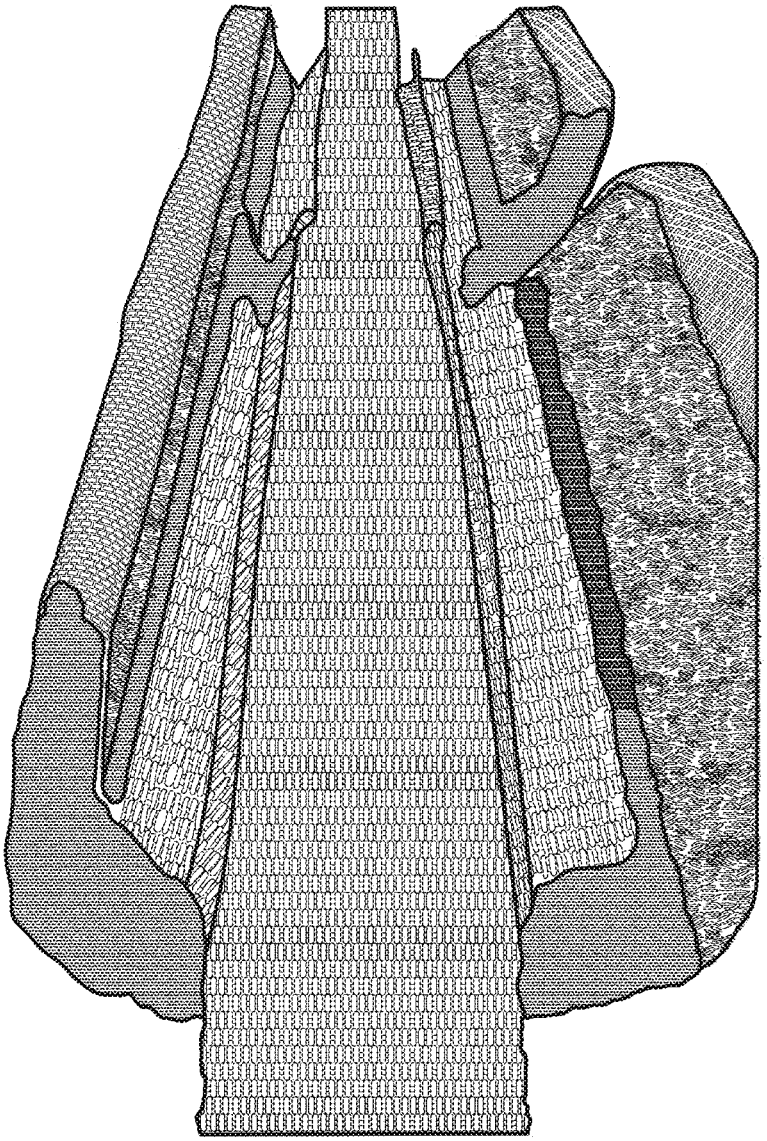
FIG. 2 shows an embodiment of a weave of the strap useful herein.

In an embodiment herein, the strap has a weave or 3D pattern which contains ridges running transverse (e.g., from side-to-side) to the length of the strap. An embodiment of a weave of the strap useful herein is shown in FIG. 2. Without intending to be limited by theory, it is believed that such a transverse weave provides greater friction when the handle is enveloping the strap and when the user is gripping and squeezing the handle with his or her hands. This in turn is believed to reduce the chance that the strap will slip within the handle during strenuous use.

Figure 3:
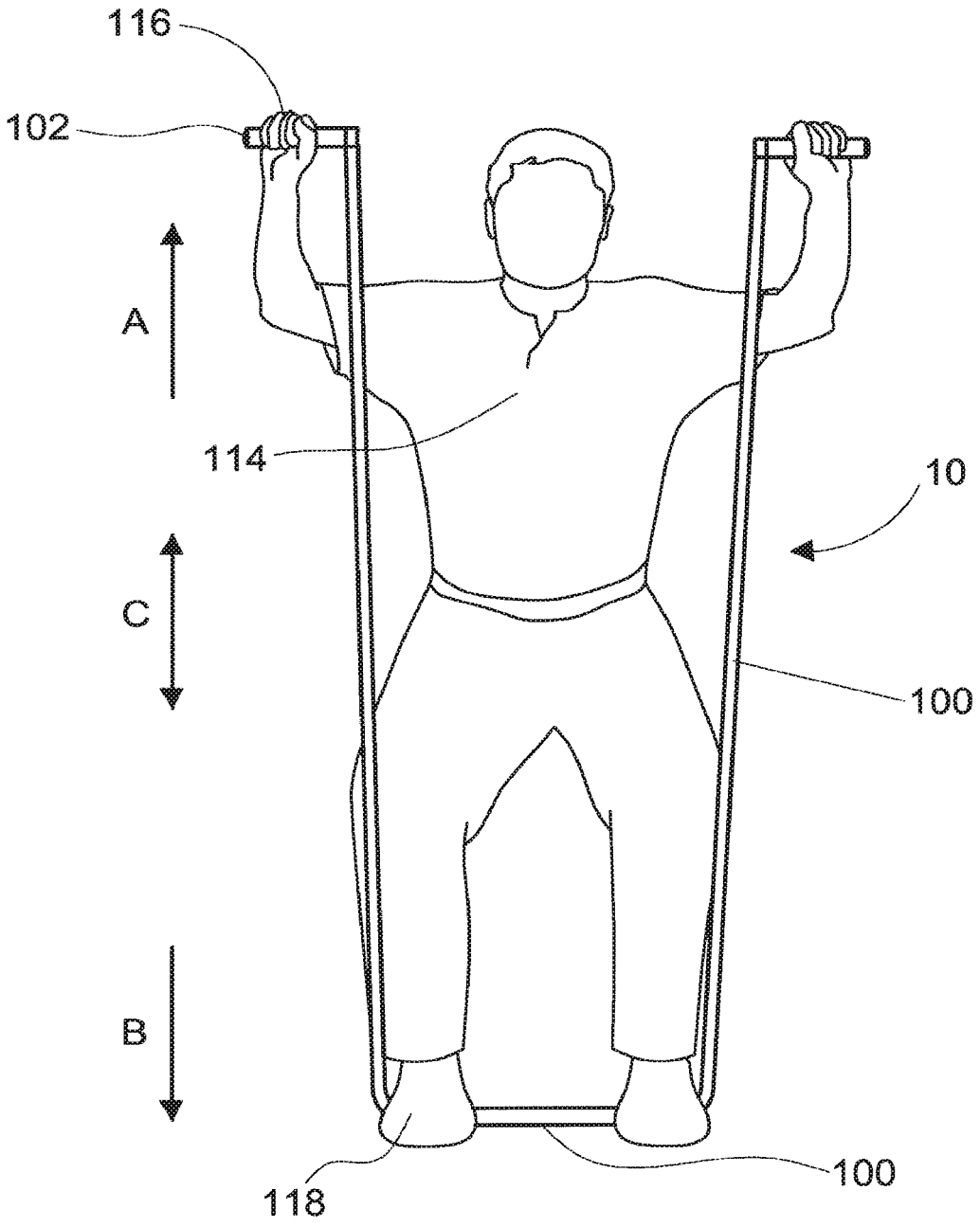
FIG. 3 shows schematic diagram of a user exercising with an embodiment of the fitness device herein.

Turning to FIG. 3, showing a schematic diagram of a user exercising with an embodiment of the fitness device herein. A user, 114, is holding the handles, 102, of the fitness device, 10, in his hands, 116, while standing on the strap, 100, with his feet, 118. In an embodiment herein, the user executes a multi-compound exercise that simulates 2 separate, free-weight assisted, compound exercises; a compound resisted standing shoulder press and a compound resisted squat. Unlike traditionally attempting either of these exercises with free-weights, this embodiment allows for the user to instantly change the weight of resistance on either muscle group in real time; as well as allowing for the 2 muscles/muscle-groups have different levels of weight resistance from one another alleviating the need for multiple sets of non-portable equipment to accommodate differing weights. Also, unlike traditionally attempting either of these exercises with free-weights this embodiment locks the user into proper form and optimal position to execute the compound exercises functionally and safely. The user would begin by standing upright with the heels of both feet on top of the strap. The feet should be spaced shoulder-width apart from one another. The middle of the strap should be exactly between the two feet. The user should bend over and each hand should grab onto each corresponding end of the strap where they exit the feet laterally. The hands should slide up the towards the ends of the strap until they are at a distance where the strap is taught with the elbow is pinned to the torso, at full flexion along the Sagittal plan & the hands are pinned to the shoulders. If the fitness device contains handles, then the handles should be adjusted accordingly. Secure both hands to the corresponding side of the strap, and/or handle. This slaves primarily the gluteus and quadricep muscles to the trapezius, deltoid and triceps brachii muscles. The trapezius, deltoid and triceps muscles then apply force on both hands secured to the strap upward along the sagittal plane while the elbow joint moves towards full extension (see the force denoted by Arrow A), this in turn puts greater resistance on the gluteus & quadricep muscles that simultaneously apply force while flexing at the knee joint downward along the sagittal plane, (see the force denoted by Arrow B) while the knee stays posterior to the mid foot. This process continues until the user is in a position where the elbow is in full extension superior to the body, and the knee is at full flexion. The process is then reversed wherein the gluteus and quadricep muscles apply force along the sagittal plane moving the knee to full extension, while the trapezius, deltoid and triceps simultaneously apply force while flexing the elbow joint downward along the sagittal plane until the user is back in the original starting position. Thus the body torso moves up and down according to Arrow C as this exercise is conducted while the hands, 116 and the feet, 118, remain substantially the same distance apart.

Additional exercises simulating bicep curls, squats, chest and hip adduction and abduction, tricep press, standing upright row, bent over back row with elbows out, bent over back row with elbows in, push-up style chest/triceps press, bent over back-fly, bent over single arm back row, abdominal crunch, standing shoulder shrug, core rotation, lateral side lunge, lower back extension, biceps hammer curl, upper/lower back raise, abdominal medicine ball contraction, single leg squat, triceps kickback, quadriceps toe squat, hamstrings flexion, shoulder shrug, hip press, standing alternating chest adduction, standing alternating 1-arm standard pull-up, chest press, standard pull-up, bent over triceps kickback, cardio quick lateral side lunge, stab and core rotation, compound pull-up, compound right oblique adduction/abduction, compound left oblique adduction/abduction, and a combination thereof; or compound resisted version of bicep curls, squats, chest and hip adduction and abduction, tricep press, standing upright row, bent over back row with elbows out, bent over back row with elbows in, push-up style chest/triceps press, bent over back-fly, bent over single arm back row, abdominal crunch, standing shoulder shrug, core rotation, lateral side lunge, lower back extension, biceps hammer curl, upper/lower back raise, abdominal medicine ball contraction, single leg squat, triceps kickback, quadriceps toe squat, hamstrings flexion, shoulder shrug, hip press, standing alternating chest adduction, standing alternating 1-arm standard pull-up, chest press, standard pull-up, bent over triceps kickback, cardio quick lateral side lunge, stab and core rotation, compound pull-up, compound right oblique adduction/abduction, compound left oblique adduction/abduction, and a combination thereof, are possible with the fitness device of the present invention. Examples of such additional exercises and methods of exercising targeting specific muscles are described in, for example, US Provisional Application No. 61/891,986, entitled A METHOD FOR GENERATING OPPOSING MUSCLE RESISTANCE, to Michael Wayne Tang, filed on Oct. 17, 2013, which is hereby incorporated by reference in its entirety.

In an embodiment herein, the user executes a compound exercise that simulates a free-weight or machine assisted, compound exercise that alternates sides. Unlike traditionally attempting this exercise with either free-weights or a large traditional exercise machine this embodiment allows for the user to instantly change the weight of resistance on either muscle group in real time; as well as allowing for the 2 sides of the muscles/muscle-groups to have different levels of weight resistance from one another alleviating the need for adjustment or multiple sets of non-portable equipment to accommodate differing weights. Also, unlike traditionally attempting this exercise with machines or with free-weights this embodiment locks the user into proper form & optimal position to execute the compound exercises functionally & safely.

In an embodiment herein, the method of use may include holding the same fitness device in different manners so as to exercise different muscle groups. For example, when the handle is held in a horizontal orientation with the palms facing away (pronated) from the body as in FIG. 3 and moving in the coronal plane, the main muscle groups being exercised are the gluteus and quadriceps in tension with the trapezius, deltoid, and triceps brachii. In contrast, when the exact same handle is held in a horizontal orientation with the palms facing (supinated) the body orientation and moving in the coronal plane, then the main muscle groups being exercised are the gluteus and quadriceps in tension with the deltoid, pectoral, and biceps brachii. Alternatively, when the handles are held vertically in an orientation where the palms or inner wrists are facing the midline of the body and moving in the sagittal plane, then the main muscle groups are the gluteus and quadriceps in tension with the deltoid, pectoral and biceps brachii.

Figure 4:
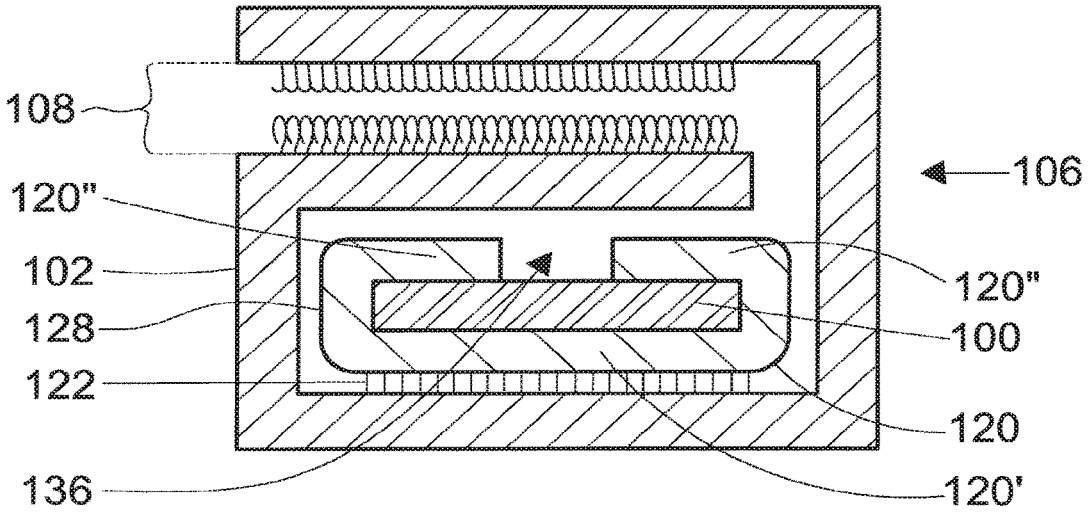
FIG. 4 shows a cross-sectional view of an embodiment of the handle of FIG. 1 as seen along line 4-4.

In FIG. 4, we see a cross-sectional view of an embodiment of the handle, 102, of FIG. 1 as seen along line 4-4. In this figure, the second grip portion, 106, is described, but this structure and description may also be generally-relevant to any handle, 102, or the first handle portion, 104. The cross-sectional view shows that the strap, 100, is enveloped by the handle, 102, which further contains therein a rail, 120, which is present to grip the strap, 100, and prevent it from moving relative to the handle, 102, during use. Thus, the rail, 120, typically employs friction to lock the handle, 102, and the strap, 100, together to reduce slippage.

In an embodiment herein the rail is formed of the same material as the strap. In an embodiment herein the rail may be about twice the width of the strap, such that it may wrap around the strap (see FIG. 7), and in doing so leave a rail gap (see FIG. 4 at 136) between the rail sides (see FIG. 4 at 120"). Typically the rail may be about the length of a handle, or may span a handle and an adjacent handle thereby including a few extra centimeters to link the two handles (see FIG. 7). Therefore the rails are typically from about 1 cm to about 16 cm; or about 1.5 to about 12 cm; or from about 2 to about 8 cm in width. The rail is typically from about 0.5 mm to about 10 mm; or about 1 mm to about 7 mm in thickness. If a rail gap is present, then the rail gap is typically from about 2 mm to about 7 cm; or from about 4 mm to about 6 cm; or form about 5 mm to about 5 cm in width.

The handle, 102, contains a locking mechanism, 108, which in this case is a hook-and-loop fastener system. Typical types of locking mechanisms useful on the first grip portion, second grip portion, and/or handle herein include a hook-and-loop fastener, a button system, a sliding lock system, a zipper, a magnetic locking system, and a combination thereof; or a hook-and-loop fastener, a magnetic locking system, and a combination thereof. In an embodiment herein the locking mechanism is a magnetic locking system where a handle magnetically locks to an adjacent handle. In an embodiment herein the magnetic locking system is calibrated such that the magnets provide sufficient attraction (and corresponding resistance on the strap) such that the handles are locked in position along the strap such that the handles' positions do not need to be readjusted if the handles are released.

FIG. 4 also shows a plate, 122, which adds rigidity to the handle and thereby provides, for example, improved leverage, a more comfortable grip, a tighter grip on the handle and/or reduced bending of the handle. Thus, in an embodiment herein the plate may be at least partially enveloped by the handle. In an embodiment herein, the plate is completely enveloped by the handle. The plate useful herein is typically substantially rigid and may be formed of many thin strips, or thick strips which themselves are not substantially rigid, but which when provided together result in the equivalent of a substantially rigid plate. As used herein, the term "substantially rigid" with respect to the plate and/or the strip means that it is more rigid than a single layer of the strap being used. In an embodiment herein, the plate, and/or the strip contains a reinforcing rib; or a plurality of reinforcing ribs; or from about 1 reinforcing rib to about 15 reinforcing ribs, to increase the rigidity. In an embodiment herein the reinforcing rib runs the length of the plate and/or the strip.

The plate and/or the strip may be formed of, for example, plastic, metal, resin, wood, and a combination thereof; or plastic; or polyethylene, polypropylene and a mixture thereof. The plate will typically be from about 1 to about 5 cm; or from about 1.5 to about 4.5; or from about 2 to about 4 cm wide. The plate will typically be from about 5 to about 20 cm; or from about 7 to about 17 cm; or from about 8 to about 15 cm long. A thick plate may be from about 0.3 cm to about 1 cm; or from about 0.2 cm to about 0.7 cm thick. A thin plate may be from about 0.05 mm to about 2.5 mm, or from about 0.07 to about 2 mm thick. In an embodiment herein, the plate is formed of a plurality of strips, typically thin strips, and typically bundled adjacent to each other so as to form the equivalent of a single substantially rigid; or rigid, plate. The number of strips in a plate may therefore be from about 1 to about 40; or from about 1 to about 35; or from about 1 to about 30 plates for each handle. Without intending to be limited by theory, it is believed that the plurality of strips which form a plate may be more resilient and lighter than a single plate. In an embodiment herein, the plates and/or strips need not be of the same width, length, and/or thickness across the entire plate and/or strip. Accordingly, in an embodiment herein the width, length, and/or thickness of a plate and/or strip varies across the plate and/or strip. Without intending to be limited by theory, it is believed that such a design may provide improved ergonomics, and/or a plate which is tailored for certain exercises.

In an embodiment herein, the plate is a custom-made plate formed by, for example, 3D printing, injection molding, and a combination thereof. Such a custom-made plate may include a plurality of strips, or may be a single one-piece plate, as desired. Such custom-made plates may be, for example, ergonomically fitted to an individual's hand, customized for a specific rigidity, customized for a specific exercise, etc.

In an embodiment herein, a plurality of plates are provided. In an embodiment herein, a plurality of plates is provided, wherein the plates are interlocking plates. In an embodiment herein, the plate contacts the strap, and further contains a texture which increases the friction between the strap and the plate. Such a texture may include one or more of a ridge, a bump, and a combination thereof.

The plate may be permanently-affixed to the handle, or may be removable as desired. In an embodiment herein a plate is permanently-affixed to the a handle and one or more plates are then affixed to the permanently-affixed plate. The plate may be permanently-affixed to the handle by, for example, sewing, bonding, and a combination thereof; or by sewing; or bar tacking. The bonding herein may be, for example, ultrasonic bonding, heat bonding, adhesive bonding, and/or chemical bonding. The plates will typically be sized and shaped so that they fit into the handle. In an embodiment herein, the handle and the plate are combined such that they are formed of a single piece of material. For example, if the plate and the handle are combined to form a D-shaped handle out of a rigid plastic. This D-shaped handle may further be partially or completely enveloped with a flexible cover, such as neoprene, to improve the user's grip, prevent slippage and/or to improve comfort.

Figure 5:
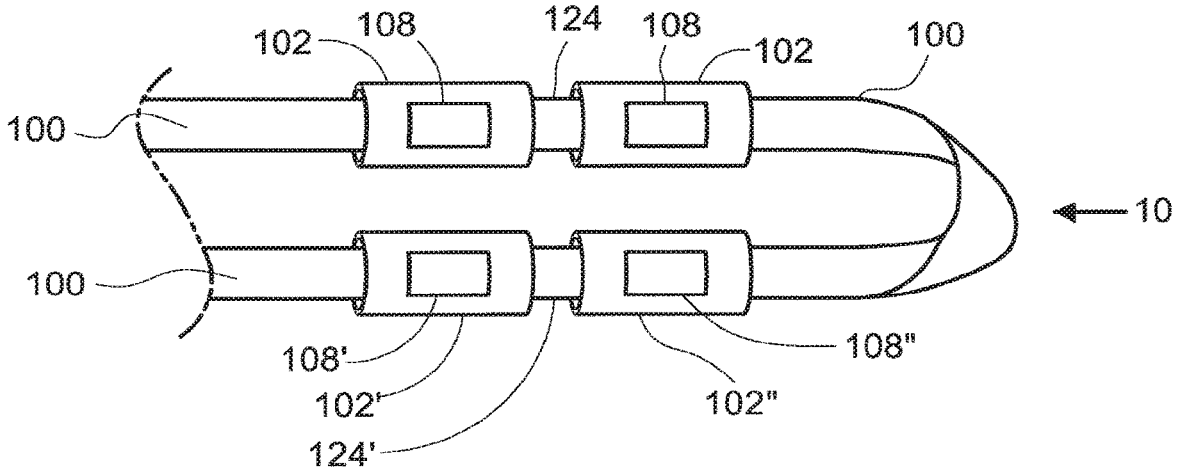
FIG. 5 shows a partial schematic view of a fitness device having multiple handles.

FIG. 5 shows a partial schematic view of a fitness device, 10, having multiple handles, 102, aligned along a strap, 100. Each handle has a locking mechanism, 108, which is intended to match up with a complementary locking mechanism, 108, on another handle, 102, typically an adjacent handle. Typically, the handle, 102', will contain a locking mechanism, 108', which is intended to match up with a locking mechanism 108" on an adjacent handle 102". In-between the adjacent handles, 102' and 102" is a handle gap, 124, which is part of the strap, 100. Without intending to be limited by theory, it is believed that such a handle gap is especially useful as it allows for various additional accessories or shaped handles to be attached thereto, such as, for example, belt clip, a nametag, or a shaped handle such as a pistol-type handle, a hammer-type handle, an "S-shaped" handle, a "D-shaped" handle, an "O"-shaped handle, a wedge-shaped handle, and/or an "8-shaped" handle, for additional exercises. Thus, in an embodiment herein, the fitness device contains at least two handles, wherein there is a length of strap therebetween to form a handle gap. In an embodiment herein the length of the handle gap is from about 1 cm to about 20; or from about 2 cm to about 10 cm. In an embodiment herein, a handle is permanently connected to an adjacent handle via a rail (see FIG. 7), and in such an embodiment, the handle and the adjacent handle would be counted as two handles, not 1 handle, even though they are connected. In an embodiment herein, the number of handles is an even number of handles. In an embodiment the accessory or shaped handle may also connect to another place other than the handle gap, for example, on the handle itself or elsewhere.

In an embodiment herein multiple handle designs are provided along with the fitness device. Without intending to be limited by theory, it is believed that although such multiple handle designs are not required in order to perform multiple exercises with the fitness device herein, such multiple handle designs may make it more convenient and/or ergonomic to perform certain exercises. For example, a wedge-shaped handle may more evenly distribute the weight and reduce the chances of slippage when a unidirectional force (or resistance) is applied.

In an embodiment herein the handle is formed from "S" form fabric bonding methods for greater strength and durability. In an embodiment herein, the handle is formed of a non-textile material. In an embodiment herein the non-textile material is a plastic, rubber, a metal, a resin, wood, and a combination thereof.

In the embodiment of FIG. 5, the strap is about 5 meters, each of the 4 handles has 1 plate, each plate contains 2 plastic strips, and the weight is about 200 g. When the plates contain 4 strips and the handles are made from a heavier rubber, then the weight is about 300 g. Furthermore, this embodiment may be folded up and packed in such a manner so as to fit in a typical pants pocket. It contains no metal and is therefore easy to carry on an airplane for traveling. It is also therefore easily washed and/or sanitized.

In the fitness device according to the embodiment of FIG. 5, the exercise of FIG. 3 can be conducted in from 3-5 square feet of floor space, depending on the user's stance and shoulder width. If the user places their feet together, then the floor space is about 1 square foot, and the total space needed is merely the width and thickness of the body and shoulders. Accordingly, such a fitness device and method are extremely space-efficient and may therefore me conducted nearly anywhere. Virtually any muscle group can be exercised while standing, or even sitting down. Furthermore, no external anchor points or particular architecture are needed, even though they could be used if desired. Also, the amount of resistance possible is typically much more than existing portable methods and equipment. Such convenience and flexibility is believed to be unique to the present invention.

Figure 6:
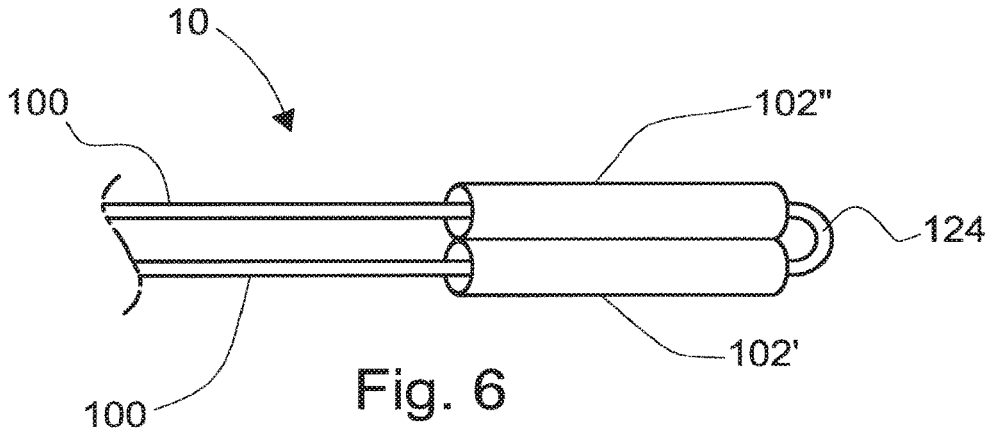
FIG. 6 shows a partial side view of the fitness device of FIG. 5 when the handles are locked together.

FIG. 6 shows a partial side view of the fitness device of FIG. 5, wherein the handle, 102' is locked together with handle. 102", by folding the strap, 100, at the handle gap, 124, so that the handle, 102' touches and locks into handle 102".

Figure 7:
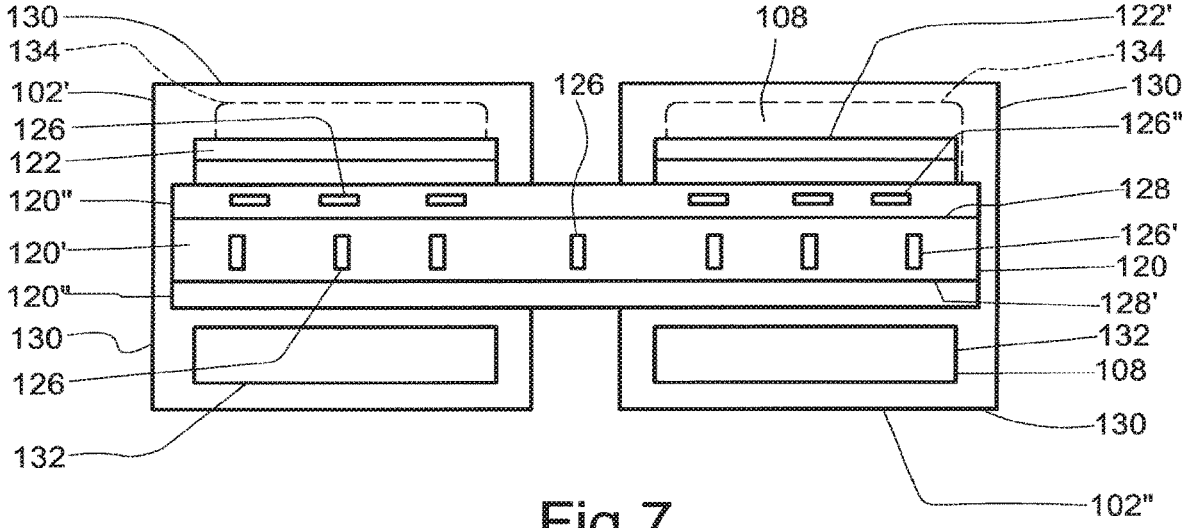
FIG. 7 shows a plan view of an embodiment of a handle and an adjacent handle that are connected by a rail.

FIG. 7 shows a plan view of an embodiment of a handle, 102', and an adjacent handle, 102" that are connected by a rail, 120. The rail, 120, is permanently-affixed to the handle, 102' and the adjacent handle, 102", by multiple instances of sewing which in this case is bar tacking, 126. The bar tacking, 126', permanently-affixes the rail, 120, to the handle, 102". Meanwhile, the bar tacking, 126", permanently-affixes the rail, 120, to the plate, 122, which in this case is a thin plastic plate. The rail, 120, further contains two rail fold lines, 128, which divides the rail, 120, into the rail center, 120', and the rail sides, 120". When the handle is enveloping the strap (not shown in FIG. 7), the strap lies in contact along the length of the rail center, 120'. The rail sides, 120", then fold over the strap, as do the plates, and the handle flaps, 130, which are the edges of the handle, 102. In an embodiment herein the plate is wider than the rail.

The handle flaps, 130, contain the locking mechanism, 108, which in this case is a hook-and-loop fastener system, where the hooks, 132, connect with the loops, 134, which are on the back-side of one set of the handle flaps. Thus, the handle flap, 130, with the loops, 134, folds down over the rail sides, 120", and then the handle is closed by folding the handle flap with the hooks, 132, over that so as to secure the locking mechanism, 108.

Turning back to FIG. 4, we can see that the rail fold line, 128, separates the rail center, 120', form the rail side, 120". The strap, 100, lies over the rail center, 120', and the rail sides, 120", fold over the strap, 100. In this embodiment the rail, 120, is about twice the width of the strap, 100. Therefore when the rail sides, 120', fold over the strap, 100, the rail leaves a rail gap, 136, between the rail sides 120". Without intending to be limited by theory, it is believed that the rail gap allows the user to better vary the friction applied to the strap by altering the pressure exerted on the handle. Such an intuitive friction control method is extremely useful in the present invention, as sometimes the user may wish to readjust the position of the handle without unlocking the locking mechanism.

Figure 8:
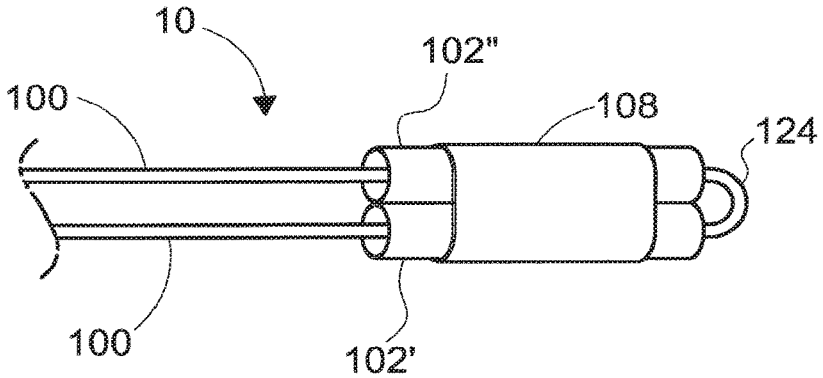
FIG. 8 shows a partial side view of a fitness device having a handle and an adjacent handle connected by a handle gap which is formed of the strap.

In an embodiment herein, FIG. 8 shows a partial side view of a fitness device, 10, having a handle, 102', and an adjacent handle, 102", connected by a handle gap, 124, which is formed of the strap, 100. The locking mechanism, 108, is a removable sleeve which slides over the handles, 102' and 102", so as to removably-secure them together.

Figure 9:
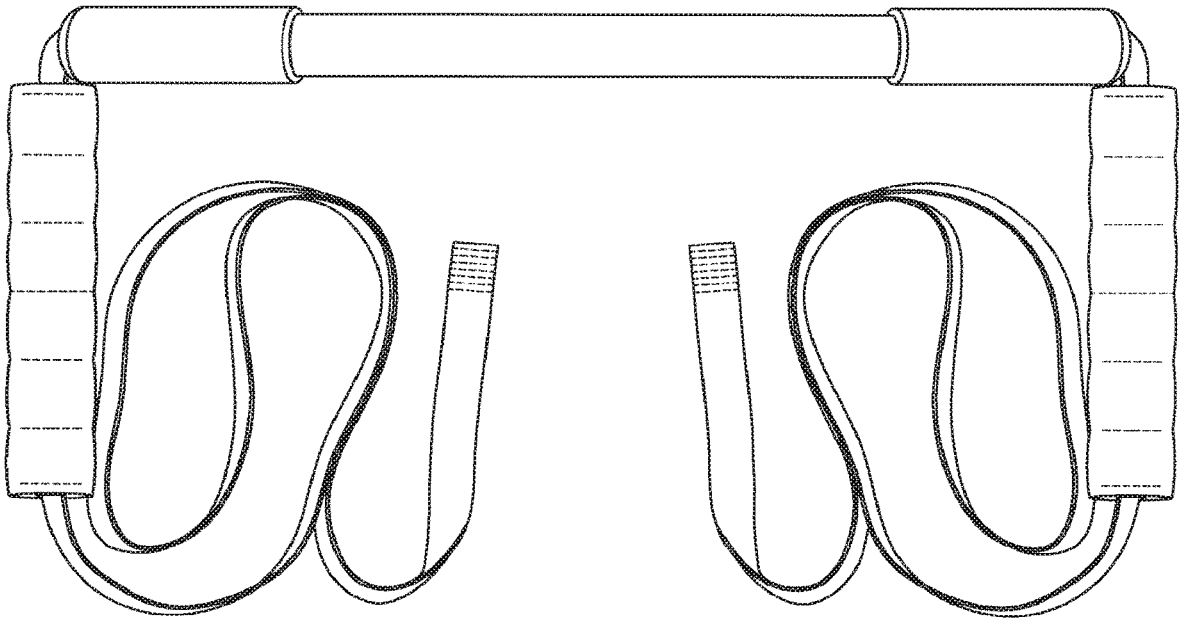
FIG. 9 shows an embodiment of the fitness device further containing a pull up bar.

In an embodiment herein, as seen in FIG. 9, the fitness device further contains a pull up bar. In such an embodiment, the strap typically is threaded through the pull up bar and at least one handle, or two handles are at each end of the pull up bar. The bar may be made from, for example, metal, plastic, rubber and a combination thereof; or plastic. The pull up bar may also contains a gripping area which may be formed from, for example, rubber, neoprene, polyurethane, and a combination thereof.

In an embodiment herein as seen in FIG. 10, the fitness device herein may further contain a cushioned fulcrum so as to allow more comfortable exercises. In an embodiment herein, the strap is threaded through the cushioned fulcrum. In an embodiment herein, the cushioned fulcrum is configured to allow the users skeletal structure to redirect and reposition the kinetic force and angle of the resistance generated by the user's large muscle groups independent of gravity. In an embodiment herein, the portable fitness device and cushioned fulcrum are configured such that the cushioned fulcrum is positioned over the user's buttocks on the posterior end of the body while the user holds the outer locking grips. In an embodiment herein, the cushioned fulcrum may contain a fabric. In an embodiment herein, the cushioned fulcrum may contain rubber, padded nylon, a plastic, neoprene, leather, and a combination thereof.

In some embodiments, the portable fitness device comprises a cushioned fulcrum. In alternative embodiments, the strap of the portable fitness device is threaded through the cushioned fulcrum. In some embodiments, the cushioned fulcrum is configured to allow the user's skeletal structure to redirect and reposition the kinetic force and angle of the resistance generated by the user's large muscle groups, independent of gravity. In alternative embodiments, the portable fitness device and cushioned fulcrum are configured such that the cushioned fulcrum is positioned over the user's buttocks on the posterior end of the body while the user holds the outer locking grips. In some embodiments, the cushioned fulcrum may comprise a fabric. In alternative embodiments, the cushioned fulcrum may comprise a rubber, padded nylon, plastic, neoprene, or leather.

In some embodiments, the user configures the body with the portable fitness device to anchor the extremities attached to the muscle group that the user intends to work. In alternative embodiments, the user configures the remaining length of the portable fitness device and anchors additional extremities to other muscle groups that the user intends to exercise. In some embodiments, the user the muscle groups and portable fitness device through a normal and complete range of options.

In some embodiments, the portable fitness device is configured to exercise the muscles of the body. In alternative embodiments, the portable fitness device is configured to exercise the biceps brachii. In some embodiments, the portable fitness device is configured to exercise the triceps brachii. In alternative embodiments, the portable fitness device is configured to exercise the shoulder muscle groups. In some embodiments, the portable fitness device is configured to exercise the shoulder girdle. In alternative embodiments, the portable fitness device is configured to exercise the upper back muscle groups. In some embodiments, the portable fitness device is configured to exercise the lower back muscles. In alternative embodiments, the portable fitness device is configured to exercise the upper abdominal muscle groups. In some embodiments, the portable fitness device is configured to exercise the lower abdominal muscle groups. In alternative embodiments, the portable fitness device is configured to exercise the leg muscle groups. In some embodiments, the portable fitness device is configured to exercise the hip muscle groups. In alternative embodiments, the portable fitness device is configured to exercise the pectoral muscle groups.

In an embodiment herein, the strap contains a loop at one end. In an embodiment herein, the strap contains a loop at each end.

In an embodiment herein, the fitness device is provided with a traveling case, a bag, a traveling clip, a bag strap, a belt clip, and/or etc. so as to make it easier and more convenient to transport.

In an embodiment herein, the strap contains a quick reel winder, compression winder, and/or automatic winder which allows quick deployment and/or quick storage.

In an embodiment herein the fitness device is a non-slip fitness device. In an embodiment the fitness device is intended for underwater use, for water sports, and/or use in a wet environment.

In an embodiment herein the fitness device contains a design containing a logo, trademark, symbol, or motto. The design may be, for example, for a sports club, an event, a hotel, etc. as desired.

In an embodiment herein, the fitness device contains adapters to allow for use by a user in a wheelchair, such as anchor points, loops, clips, etc. for attachment to a wheelchair, or other point to compensate for either a missing limb, or limb or muscle/muscle group which is unable to provide sufficient resistance. In an embodiment herein the fitness device further contains additional handles, loops, and/or straps for multi-person use.

In an embodiment herein, the fitness device may contain or may be sued with additional, traditional exercise equipment such as weights, resistance bands, etc. Without intending to be limited by theory, such a variation may especially be useful for more intense cardio workouts.

In an embodiment herein, the fitness device is formed of a stronger, more robust strap material, and or multiple straps, for especially strong, frequent and/or rigorous users. In an embodiment herein, the fitness device is made with extremely ultralight materials which still provide significant strength and durability. Without intending to be limited by theory, it is believed that such a version may be highly desirable by frequent travelers, those seeking low resistance "maintenance workouts", campers, hikers, and the like.

In an embodiment herein, the fitness device further includes a sensor; or a plurality of sensors. The sensor may measure one or more parameters such as, for example, the strain from the strap and convert such a strain measurement into an equivalent weight to use as a reference, the time the fitness device is used, the speed at which the fitness device is used, the type of exercise conducted, etc. The sensor herein may be physically-attached to the fitness device and/or may be provided in conjunction with the fitness device. The sensor may be a wireless sensor, and/or may transmit data via wires, or wirelessly to a receiving unit. The fitness device may contain, for example, one or more of a transmitting unit, a receiving unit, a processor, an indicator, etc. In an embodiment herein the sensor measures a parameter; or multiple parameters; to generate data and transmits the data to a display device containing a receiving unit. In an embodiment herein, the display device is a smartphone, for example, running a specific application which translates the data into meaningful output for the user. In an embodiment herein the sensor is located in the handle.

In an embodiment herein, the fitness device and the exercise method is connected to and/or utilizes an exercise ecosystem including one or more of a video, a portable health instrument, a personalized trainer, a customized training regimen, a certification program, a website, a monitoring program, etc. In an embodiment herein, the portable health instrument is selected from a smartphone, a watch, a necklace, an anklet, a heads-up display, a mask, an earpiece, a ring, a bracelet, an undergarment, a shirt, an armband, etc. In an embodiment herein, the portable health instrument contains a receiving unit. In an embodiment herein, the portable health instrument contains or is a display device as described herein.

In an embodiment herein the strap contains a visible mark which indicates the middle of the strap length. Without intending to be limited by theory, it is believed that this visible mark may help the user recognize the middle of the strap length so as to be better able to orient their body and/or to gauge where to affix the handles.

In an embodiment herein, the fitness device weighs from about 25 g to about 3 kg; or from about 30 g to about 2.5 kg; or from about 40 g to about 2 kg; or about 40 g to about 1.5 kg; or from about 42 g to about 500 g. Typically this weight is calculated without any accessories or shaped handles.

In an embodiment herein, the fitness device is provided with the handles locked together and the strap wound around the handles.

Additional features and characteristics which may be useful herein are described in, for example, U.S. Provisional Patent Application No. 61/910,626 entitled PORTABLE FITNESS DEVICE FOR GENERATING INTERNALLY RESISTED COMPOUND EXERCISES to Michael Wayne Tang, filed on Dec. 2, 2013; U.S. Provisional Patent Application No. 61/910,602 entitled PORTABLE FITNESS DEVICE WITH CUSHIONED FULCRUM FOR GENERATING INTERNALLY RESISTED COMPOUND EXERCISES to Michael Wayne Tang, filed on Dec. 2, 2013; and U.S. Provisional Patent Application No. 61/910,612 entitled PORTABLE FITNESS DEVICE FOR PULL UPS AND GENERATING INTERNALLY RESISTED COMPOUND EXERCISES to Michael Wayne Tang, filed on Dec. 2, 2013; all of which are hereby incorporated by reference in their entireties.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable sub-combination.

What is claimed is:

1. An exercising method by creating opposing internal muscle resistance instead of employing weights, gravity, or elastic bands, the method intended for strength training and comprising:

enveloping a substantially inelastic strap with a handle including an internal rail;

securing a first portion of the substantially inelastic strap to a first body part associated with a first targeted muscle or muscle group, the securing the first portion of the substantially inelastic strap to the first body part comprises manually gripping the handle enveloping the substantially inelastic strap to frictionally engage the internal rail against the substantially inelastic strap to hold the handle in a desired position along the substantially inelastic strap;

securing a second portion of the substantially inelastic strap to a second body part associated with a second targeted muscle or muscle group, wherein a portion of the substantially inelastic strap extends between the first portion and the second portion;

creating opposing internal muscle resistance by pulling the first body part away from the second body part to create a state of opposing internal muscle resistance in both the first targeted muscle or muscle group and the second targeted muscle or muscle group to generate a corresponding tensioned state in the substantially inelastic strap in which the substantially inelastic strap defines a substantially fixed distance along the substantially inelastic strap between the first body part and the second body part; and moving a portion of the body while maintaining the state of opposing internal muscle resistance in both the first targeted muscle or muscle group and the second targeted muscle or muscle group to generate the corresponding tensioned state of the substantially inelastic strap in which the substantially inelastic strap defines the substantially fixed distance along the substantially inelastic strap between the first and second body parts in order to simultaneously subject the first targeted muscle or muscle group and the second targeted muscle or muscle group to internal resistance exercise against each other.

2. The method of exercising by creating opposing internal muscle resistance of claim 1, wherein securing a second portion of the substantially inelastic strap to a second body part comprises securing the second portion of the substantially inelastic strap to the second body part at a second handle, wherein the handle and the second handle are spaced from each other to create a loop in the substantially inelastic strap between the handle and the second handle, and further comprising securing the loop to another body part.

3. The method of exercising by creating opposing internal muscle resistance of claim 1, wherein the first body part is one or both hands, and wherein the second body part is one or both feet.

4. The method of exercising by creating opposing internal muscle resistance of claim 1, wherein the first body part is a first hand, and wherein the second body part is a second hand.

5. The method of exercising by creating opposing internal muscle resistance of claim 1, wherein the first targeted muscle or muscle group is smaller than the second targeted muscle or muscle group.

6. The method of exercising by creating opposing internal muscle resistance of claim 1, wherein the first body part is one or both hands, wherein the second body part is one or both feet, and wherein the first targeted muscle or muscle group is smaller than the second targeted muscle of muscle group.

7. The method of exercising by creating opposing internal muscle resistance of claim 1, wherein moving the portion of the body comprises moving the portion of the body between the first and second body parts toward and away from the first and second body parts in an alternating fashion.

8. The method of exercising by creating opposing internal muscle resistance of claim 1, wherein moving the portion of the body between the first and second body parts comprises performing a shoulder press exercise movement with the first targeted muscle or group of muscles while simultaneously performing a squat exercise movement with the second targeted muscle or group of muscles.

9. The method of exercising using opposing internal muscle resistance of claim 1, wherein the state of opposing internal muscle resistance is between a deltoid and triceps brachii muscle group as the first targeted muscle group and a gluteus and quadriceps muscle group as the second targeted muscle group.

10. The method of exercising by creating opposing internal muscle resistance according to claim 1, wherein the opposing internal muscle resistance is created while providing consistent tension.

11. The method of exercising by creating opposing internal muscle resistance according to claim 1, wherein a user's skeletal structure redirects and repositions a kinetic force and an angle of the opposing internal muscle resistance.

12. The method of exercising by creating opposing internal muscle resistance of claim 11, wherein the substantially inelastic strap traverses a user's back.

13. The method of exercising by creating opposing internal muscle resistance of claim 1, wherein the method is conducted in space.

14. The method for exercising by creating opposing muscle resistance of claim 1, wherein the first targeted muscle or muscle group comprises a weaker and/or smaller muscle group;

wherein the securing of a second portion of the substantially inelastic strap to a second body part comprises anchoring an extremity, and wherein the second targeted muscle or muscle group comprises a stronger and/or larger muscle group; and wherein the creating of opposing internal muscle resistance comprises using the first targeted muscle or muscle group at its maximum potential.

15. The method for exercising by creating opposing muscle resistance of claim 14, further comprising the step of:

Using the second targeted muscle or muscle group to move the first targeted muscle or muscle group through its normal and complete range of motion.

16. The method for exercising by creating opposing muscle resistance of claim 1, further comprising the step of:

using the second targeted muscle or muscle group to move the first targeted muscle or muscle group through its normal and complete range of motion.

* * * * *